US006227131B1

(12) United States Patent
Strong et al.

(10) Patent No.: US 6,227,131 B1
(45) Date of Patent: May 8, 2001

(54) SAILBOAT RUDDER HAVING A MONOCOQUE STRUCTURE

(75) Inventors: Jeffrey W. Strong, Jupiter; John R. Newton, Boca Raton, both of FL (US)

(73) Assignee: Tides Marine, Inc., Deerfield Beach, FL (US)

( * ) Notice: Subject to any disclaimer, the term of this patent is extended or adjusted under 35 U.S.C. 154(b) by 0 days.

(21) Appl. No.: 08/858,545

(22) Filed: May 19, 1997

(51) Int. Cl.[7] ..... B63H 25/38
(52) U.S. Cl. ..... 114/162
(58) Field of Search ..... 440/101; 114/162, 114/127, 140, 357; 441/79

(56) References Cited

U.S. PATENT DOCUMENTS

| | | | | |
|---|---|---|---|---|
| 3,873,654 | * | 3/1975 | Smith | 264/46.4 A |
| 4,713,032 | * | 12/1987 | Frank | 441/74 |
| 4,955,839 | * | 9/1990 | Kaschper | 440/101 |
| 5,032,096 | * | 7/1991 | Scott et al. | 114/140 |
| 5,056,451 | * | 10/1991 | Howlett | 114/162 |
| 5,176,839 | * | 1/1993 | Kim | 249/78 |

FOREIGN PATENT DOCUMENTS 7-232336 * 9/1995 (JP) .

* cited by examiner

*Primary Examiner*—Sherman Basinger
(74) *Attorney, Agent, or Firm*—Hopgood, Calimafde, Judlowe & Mondolino

(57) ABSTRACT

A rudder for a sailboat or other vessel formed by a light-weight core having the combined shape of the blade and the stock of the rudder, and a fiber-reinforced resin skin enveloping the core and conforming thereto to create a monocoque structure in which the skin bears the major portion of the torsional and bending stresses to which the rudder is subjected when in use. The pre-cast foam-plastic core of the rudder is formed by a blade section and a stock section having a root received in a slot in the blade section, the stock section being wrapped with a layer of reinforcing fibers before being combined with the blade section. To produce the rudder, the pre-cast core is placed in the cavity of a mold lined with reinforcing fibers which wrap the core inserted therein. Then injected into the closed mold is a flowable resin which impregnates the fibers wrapping the core whereby when the resin cures, these fibers are bonded to and reinforce the resultant resin skin enveloping the rudder core to create a monocoque rudder structure of exceptional strength.

13 Claims, 4 Drawing Sheets

SAILBOAT RUDDER HAVING A MONOCOQUE STRUCTURE

BACKGROUND OF INVENTION

1. Field of Invention

This invention relates generally to rudders for vessels, and more particularly to a sailboat rudder formed by a light weight core and a fiber-reinforced resin skin enveloping the core and conforming thereto to create a monocoque structure, and to a method for producing this rudder.

2. Status of Prior Art

A rudder is a mechanism for steering a ship or other vessel. A ship's rudder is formed by a blade supported on a stock which is hinged to the stern and controlled by a helm. When the ship is on a straight course, the blade of the rudder is then in line with the vessel. If the rudder is turned to one side or the other, the blade then offers sufficient resistance to the flow of water to deflect the stern and thereby change the direction of the ship. The structural strength of a rudder must be such that it is capable of withstanding the forces of water impinging on its surface, and its hydrodynamic design must be such that the rudder operates efficiently.

The concern of the present invention is with rudders for sailboats and the special requirements for such rudders, such as light weight and high strength, as well as a hydrodynamic design appropriate to the boat on which the rudder is installed.

A sailboat rudder now in widespread use has a stock formed of a stainless steel tube, rather than of a heavier solid metal. Welded onto the lower end of the stock are metal fins, the lower end of the stock being sandwiched between complementary half-sections of a blade. These half-sections are made of fiberglass-reinforced resin (FRP) skins which are held together by a foam-plastic core injected between the skins. Hence the blade itself is relatively light weight. But this known form of rudder, as will now be explained, suffers from several drawbacks.

A stainless steel tubular stock is subject to crevice corrosion and electrolysis, and it reacts differently to temperature changes than the half-sections of the FRP blade joined to the stock. As a consequence, the FRP blade sections will eventually sheer away from the steel stock, allowing water to penetrate the foam-plastic core through the exposed interface between the half-sections.

Another drawback is that when making this rudder, the FRP half-sections of the blade must be placed in a mold into which is injected the foam-plastic material which, when cured, forms the core that holds the blade half-sections together. With this molding method, one is unable to determine whether the foam-plastic core had cured evenly within the mold, yet only then does the core properly hold the blade half-sections together.

A more serious drawback of a prior art sailboat rudder of this type is that its hydrodynamic design is not determined by proper design considerations, but is dictated by the diameter of the tubular sheet stock inserted between the FRP complementary half-sections of the blade. Hence the blade may be unduly thick, making it easier to stall the boat and imparting poor lift characteristics thereto.

Still another drawback of this prior art sailboat rudder is that because the two FRP half-sections of the blade are held together by a foam-plastic core, the leading and trailing edges of the blade have an exposed interface. Hence should these edges of the blade be struck by floating debris or other objects, the two half-sections of the blade may then delaminate, with a resultant failure of the rudder.

In an aircraft, a monocoque structure is one in which the stressed outer metal skin carries all or a major portion of the torsional and bending stresses to which the structure is subjected. A rudder in accordance with the invention has a unique monocoque structure in that it is formed of a core whose shape and size define both the blade and stock of the rudder, the core being enveloped in an outer skin that conforms to the core and mainly bears the stresses to which the rudder is subjected.

SUMMARY OF INVENTION

In view of the foregoing the main object of this invention is to provide a sailboat rudder whose blade and stock are integrated into a monocoque structure.

More particularly, an object of this invention is to provide a rudder of the above type formed of a light-weight core having the combined shape of the blade and the stock, the core being enveloped by a fiber-reinforced resin skin which bears the major portion of the stresses to which the rudder is subjected.

Among the significant advantages of a rudder in accordance with the invention are the following:

A. The hydrodynamic shape of the rudder is not dictated by the stock, but by optimum design considerations which render the blade of the rudder the most effective "wing" for the sailboat on which it is to be installed.

B. The rudder pivot point can be positioned correctly without regard to the diameter of the stock.

C. Because the rudder does not include a metal stock or other metallic components, it is not subject to corrosion or electrolysis.

D. The foam-plastic core does not impart significant strength to the rudder whose strength and other structural properties are largely determined by the FRP skin enveloping the core to create a monocoque structure.

E. The monocoque rudder is not only lighter than known rudders of similar size and shape, but it is also significantly stronger than those rudders, yet is less expensive to fabricate.

Briefly stated, these objects are accomplished by a rudder for a sailboat or other vessel formed by a lightweight core having the combined shape of the blade and the stock of the rudder, and a fiber-reinforced resin skin enveloping the core and conforming thereto to create a monocoque structure in which the skin bears the major portion of the torsional and bending stresses to which the rudder is subjected when in use.

The pre-cast foam-plastic core of the rudder is formed by a blade section and a stock section having a root received in a slot in the blade section, the stock section being wrapped with a layer of reinforcing fibers before being combined with the blade section. To produce the rudder, the pre-cast core is placed in the cavity of a mold lined with reinforcing fibers which wrap the core inserted therein. Then injected into the closed mold is a flowable resin which impregnates the fibers wrapping the core whereby when the resin cures, these fibers are bonded to and reinforce the resultant resin skin enveloping the rudder core to create a monocoque rudder structure of exceptional strength.

BRIEF DESCRIPTION OF DRAWINGS

For a better understanding of the invention as well as other objects and further features thereof, reference is made to the following detailed description to be read in conjunction with the accompanying drawings, wherein.

DESCRIPTION OF INVENTION

A process in accordance with the invention for fabricating a rudder for a sailboat or other vessel makes use of a fiber-reinforced plastic (FRP) skin enveloping and conforming to a core to create a one-piece monocoque rudder having the following characteristics:

I. Superior Hydrodynamic Shape

The process allows for a smooth transition from the blade of the rudder to its stock by forming these components in a single part. The stock of the rudder does not dictate the shape of the blade, whose shape is based on optimum design considerations appropriate to the vessel for which the rudder is designed.

II. Stronger Construction

The rudder is formed by a light-weight core, preferably a high-density foam-plastic material, and fiberglass and carbon fiber layers which are bonded together by an epoxy resin to create the outer skin of the monocoque rudder. The strength of the rudder does not depend on the structural properties of the core, but is derived from its outer skin which has sufficient strength to cope with all loads imposed on the rudder, no substantial portion of these loads being transferred to the core.

III. Lighter Weight

A reduction in the overall weight of the rudder is achieved by using materials having the highest tensile strength per pound, such as carbon fibers, E-glass and S-glass fibers, as well as epoxy resins.

The successive steps involved in a process for producing a rudder in accordance with the invention will now be described in connection with FIGS. 1 to 12.

Figure 1:
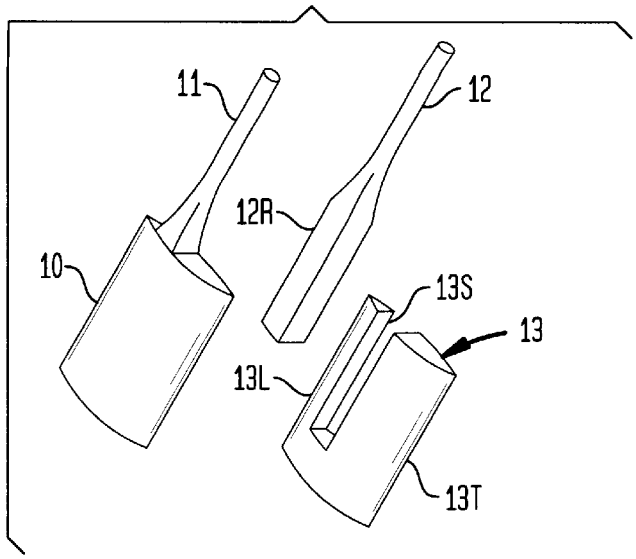
FIG. 1 shows the pattern of a sailboat rudder to be produced in a technique in accordance with the inventions, and the blade and stock section of the core of this rudder.

Step A:

The first step in making the rudder is for a designer to create the desired pattern whose configuration, as shown in FIG. 1, has a blade 10 and a stock 11 integral therewith. The shape and size of this rudder pattern represent the optimum hydrodynamic design for the sailboat or other vessel for which the rudder is intended. The particular pattern shown in FIG. 1 is therefore by way of example only.

A rudder in accordance with the invention has a high-density foam-plastic core made of polyurethane or similar material having good structural properties, enveloped by a fiber-reinforced resin skin to create a monocoque rudder. In producing this rudder it is first necessary to mold the foam-plastic core.

The core must be molded so that it is somewhat undersized to allow for the enveloping skin. As shown in FIG. 1 this core is made of two parts. One foam-plastic part of the core rudder stock 12 which includes a root 12R having a square crossection. The other part of the core is the rudder blade 13. This blade has a leading edge 13L, a trailing edge 13T and a slot 13S parallel to these edges dimensioned to receive root 12R of the stock. Thus the core is produced by combining parts 12 and 13.

Figure 2:
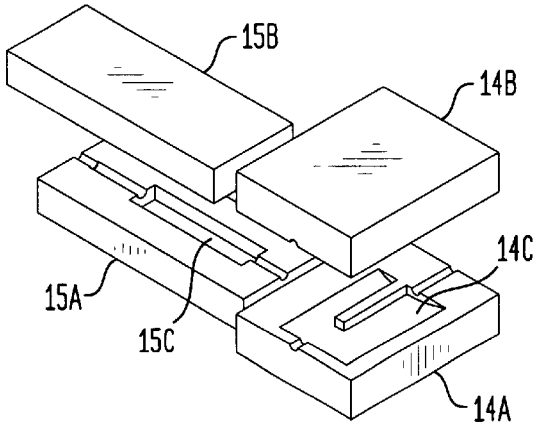
FIG. 2 illustrates the two molds for casting the blade and stock sections of the core.

The mold for molding stock 12 of the core and the mold for molding the blade part are shown in FIG. 2. The two-part mold formed by a lower section 14A and an upper section 14B is for molding the blade section 13 of the core. Hence the shape of the cavity 14C in lower section 14A of the mold conforms to the shape of this blade section.

And the two part mold 15A and 15B is for molding stock section 12 of the core includes a cavity 15C conforming to the stock section.

Figure 3:
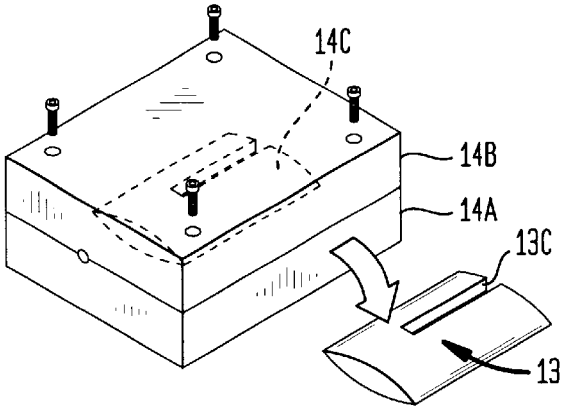
FIG. 3 illustrates the closed mold in which the blade section is molded.

FIG. 3 illustrates the operation of mold sections 14A and 14B when these sections are closed to mold blade section 13 of the core. Coming out of this mold is the foam-plastic blade section 13 having a slot 13C to receive root 12R of stock section 12.

Figure 4:
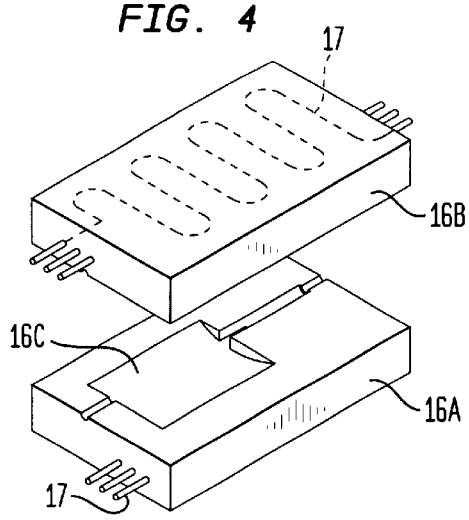
FIG. 4 shows the mold for molding the rudder.

Step B:

The next step is to provide, as shown in FIG. 4, a mold for forming the rudder. This mold has complementary lower and upper sections 16A and 16B, and a mold cavity 16C whose shape and size match the rudder shown in FIG. 1 formed by a rudder blade 10 and a stock 11. The sections of this mold are provided with cooling lines 17 to assist in curing the resin injected into the mold. In practice, the mold may be formed of a polymeric concrete or other durable material which makes it possible to use the same mold to cast a large number of rudders.

Before placing the foam-plastic core composed of stock section 12 and blade section 13 in cavity 16C of this mold, it is necessary to first wrap stock section 12 with reinforcing fibers before root 12R of the stock section is then inserted in slot 13S of the blade section 13 of the core to combine these sections.

Figure 5:
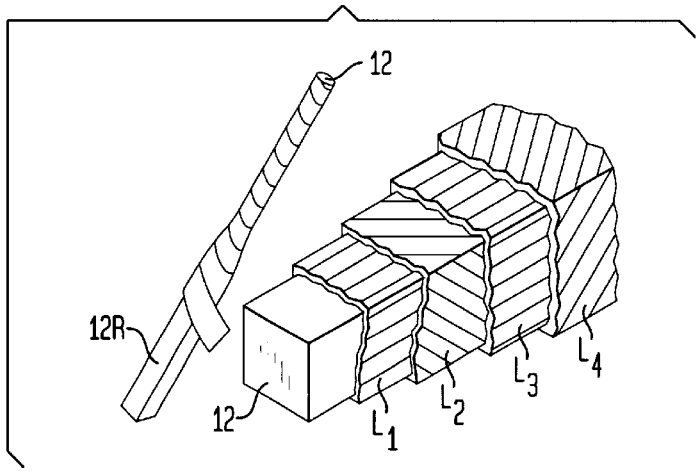
FIG. 5 illustrates how the stock section of the core is wrapped.

In order to wrap stock section 12, then as shown in FIG. 5, a layer $L_1$ of unidirectional carbon fiber is laid along the foam-plastic stock section 12 from top to bottom. Layer $L_1$ is then wrapped with a strip $L_2$ of unidirectional S glass fiber at a positive 45 degree angle. This holds the carbon fiber layer $L_1$ in place and provides the correct "hoop" strength for the part. Another layer $L_3$ of carbon fiber is applied thereto, and this is wrapped by another strip $L_4$ of unidirectional S glass at a negative 45 degree angle. Stock section 12 is then fully wrapped.

Figure 6:
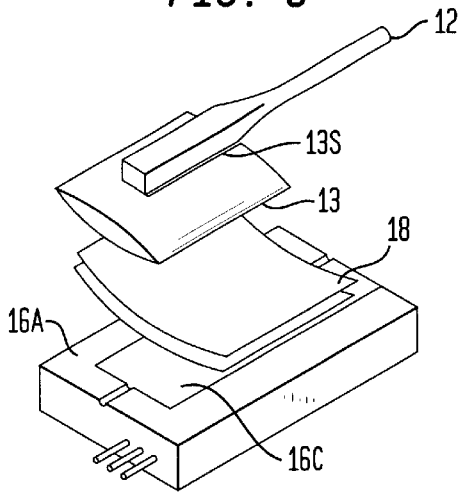
FIG. 6 illustrates how the mold for producing the rudder is prepared to receive the core.

Step C:

As shown in FIG. 6, wrapped stock section 12 of the core is inserted in slot 13C of blade section 13 and the core is now in condition to be placed in the mold in which the core is to be enveloped in a fiber-reinforced skin.

Figure 7:
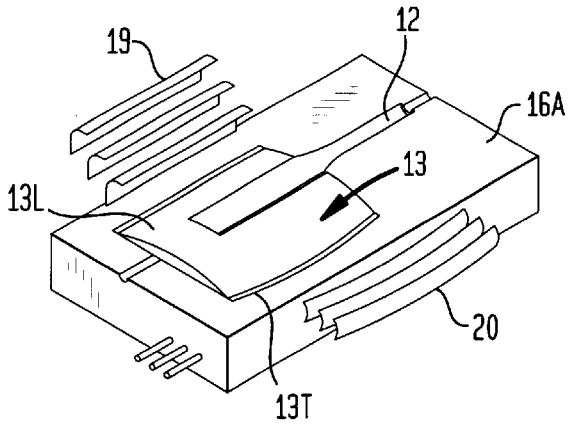
FIG. 7 shows how folded strips are added to the leading and trailing edges of the blade sections of the core.

To create this skin, placed in cavity C in lower section 16A of the mold are two superposed sheets 18 of biaxial, 45 degree E-glass. These sheets are cut to extend out several inches beyond mold cavity 16C. Then as shown in FIG. 7 several folded strips 19 of the same reinforcing material are added to leading edge 13L of the blade section of the core, and several folded strips 20 are added to trailing edge 13T.

Figure 8:
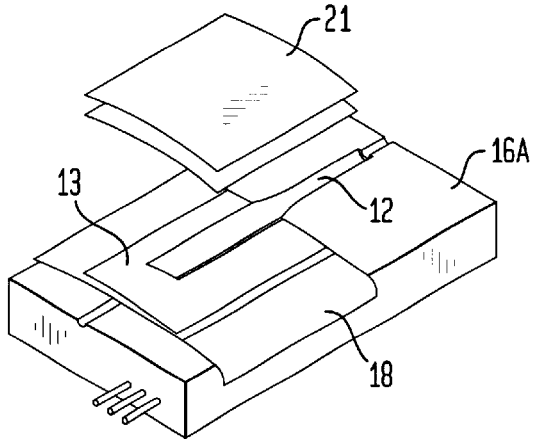
FIG. 8 illustrates how fiber layers are laid over the core sections nested in the mold cavity.
Figure 9:
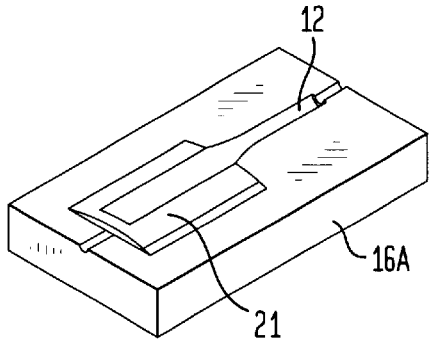
FIG. 9 shows how the mold is prepared for final casting of the rudder.

Then as shown in FIG. 8, two additional superposed sheets 21 of biaxial, 45 degree E-glass are laid over the top of the blade and stock core sections in the mold. Once again the sheets are cut to extend several inches beyond the edges of the mold cavity. Bottom sheets 18 and top sheets 21 are then folded over the strips on the leading and trailing edges of the blade section of the core, thereby completing the wrap as shown in FIG. 9. Thus the foam-plastic core composed of a blade section and a stock section are fully wrapped within lower section 16A of the mold.

Figure 10:
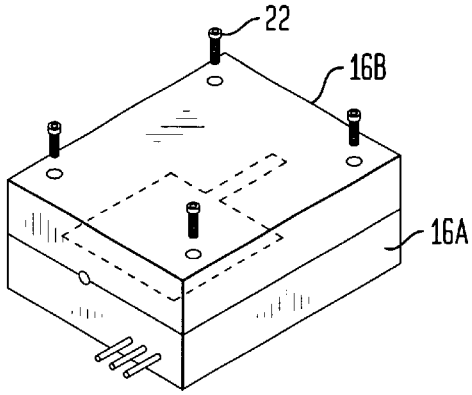
FIG. 10 shows the closed mold in readiness for injection.

Step D:

As shown in FIG. 10, the two sections 16A and 16B of the mold within whose cavity is the foam-plastic core covered by sheets of fiber reinforcing material are closed by bolts 22, and hose fittings are added to the inlet and outlet of the mold.

Figure 11:
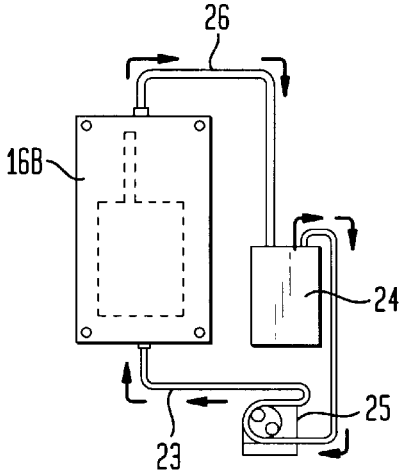
FIG. 11 shows how the closed mold has resin injected therein.

Injected under pressure into the cavity of the closed mold, as shown in FIG. 11, through hose fitting 23 is a flowable epoxy resin drawn from a tank 24 by a pump 25. To do this, the mold is stood on end so that the inlet fitting 23 is at the bottom and an outlet fitting 26 is at the top to provide a return path to tank 24.

This closed circuit injection system removes all air from between the core sections and the mold cavity by recycling the resin from the tank, leaving the fiber/resin combination free of bubbles and voids.

Figure 12:
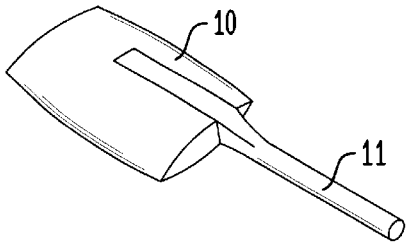
FIG. 12 shows the finished rudder after it has been removed from the mold.

The resin is allowed to cure in a temperature controlled environment, bonding all fibers in the wrapping about the stock section and bonding the fibers covering the leading and trailing edges of the blade section into a unified part in which the foam-plastic core defining the blade and stock of the rudder is enveloped in a fiber reinforced skin. This skin produce a one piece monocoque rudder structure, as shown in FIG. 12, having a blade 10 and a stock 11 integral therewith. The rudder is removed from the mold and the flashing is trimmed to provide the finished rudder.

Because the stock section of the rudder is fully wrapped, and the wrapped stock section is received in a slot section which is then wrapped, this reinforces the junction of the two sections.

While there has been shown and described a preferred embodiment of a sailboat rudder having a monocoque structure in accordance with the invention, it will be appreciated that many changes and modifications may be made therein without, however, departing from the essential spirit thereof. Thus instead of forming the core of foam-plastic material which is pre-cast, the core can be machined of end-grain balsa wood having greater structural strength than foam-plastic material despite its light weight.

We claim:

1. A rudder having a blade and a stock for a sailboat or other vessel, in which in the course of operation the rudder is subjected to stresses which seek to sever the blade from the stock, comprising:

A. a light weight core shaped to define the blade and stock of the rudder and the junction therebetween, said core formed of a blade section having a slot therein and a stock section having a root which is received in said slot to combine the stock section with the blade section; and B. a fiber-reinforced resin skin enveloping the stock and the blade of the core as well as the junction therebetween and conforming thereto to create a monocoque structure in which the skin bears the major portion of torsional and bending stresses to which the rudder is subjected when in use.

2. A rudder as set forth in claim 1, in which the core is formed of synthetic plastic foam material.

3. A rudder as set forth in claim 1, in which the fiber reinforcing the skin includes carbon and glass fibers.

4. A rudder as set forth in claim 1, in which the resin is an epoxy resin.

5. A method of producing a rudder of the type set forth in claim 1 comprising the steps of:

A. casting a plastic core defining the blade and stock of the rudder and the junction therebetween, which core is undersized to allow for subsequent formation of said skin and is comprised of a stock section having a root and a blade section having a slot therein to receive the root to combine the two sections together;

B. forming a mold having a cavity whose shape and size define the contours of the blade, stock and junction of the rudder to be produced;

C. lining said cavity with fibers to surround the undersized core placed therein; and D. injecting into said mold a flowable resin to impregnate said fibers surrounding the core whereby when the resin is cured, said fiber-reinforced resin skin is then created.

6. A method as set forth in claim 5, in which said fibers include glass and carbon fibers.

7. A method as set forth in claim 5, in which the resin is an epoxy.

8. A method as set forth in claim 5, in which the core is formed of high-density synthetic plastic foam material.

9. A rudder having a blade and a stock for a sailboat or other vessel, in which in the course of operation the rudder is subjected to stresses which seek to sever the blade from the stock, comprising:

A. a light weight core shaped to define the blade and stock of the rudder and the junction therebetween, said core being formed of a synthetic plastic foam material and said stock section being wrapped in a fiber-reinforcing material before being combined with the blade section; and B. a fiber-reinforced resin skin enveloping the stock and the blade of the core as well as the junction therebetween and conforming thereto to create a monocoque structure in which the skin bears the major portion of torsional and bending stresses to which the rudder is subjected when in use.

10. A rudder as set forth in claim 9, in which the core is formed of a blade section having a slot therein and a stock section having a root which is received in said slot to combine the stock section with the blade section.

11. A rudder as set forth in claim 9, in which the fiber reinforcing the skin includes carbon and glass fibers.

12. A method of producing a rudder of the type set forth in claim 1 comprising the steps of:

A. casting a plastic core defining the blade and stock of the rudder and the junction therebetween, which core is undersized to allow for subsequent formation of said skin, said core being formed of a synthetic plastic foam material and said stock section being wrapped in a fiber-reinforcing material before being combined with the blade section;

B. forming a mold having a cavity whose shape and size define the contours of the blade, stock and junction of the rudder to be produced;

C. lining said cavity with fibers to surround the undersized core placed therein; and D. injecting into said mold a flowable resin to impregnate said fibers surrounding the core whereby when the resin is cured, said fiber-reinforced resin skin is then created.

13. A method as set forth in claim 12, in which the core is formed of a blade section having a slot therein and a stock section having a root which is received in said slot to combine the stock section with the blade section.

* * * * *